US006381420B1

(12) United States Patent
Sato et al.

(10) Patent No.: US 6,381,420 B1
(45) Date of Patent: Apr. 30, 2002

(54) DEVELOPER REPLENISHING MECHANISM

(75) Inventors: Mitsuhiko Sato, Numazu; Rieko Akiba, Shizuoka-ken, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/588,736

(22) Filed: Jun. 7, 2000

(30) Foreign Application Priority Data

Jun. 9, 1999 (JP) ..... 11-162401

(51) Int. Cl.[7] ..... G03G 15/08; G03G 15/00
(52) U.S. Cl. ..... 399/27; 399/81; 399/263
(58) Field of Search ..... 399/13, 27, 61, 399/81, 119, 120, 258, 262, 263

(56) References Cited

U.S. PATENT DOCUMENTS 5,055,881 A * 10/1991 Fukuchi ..... 399/13
5,305,063 A * 4/1994 Marumoto ..... 399/13
5,331,373 A 7/1994 Nomura et al.
5,374,977 A * 12/1994 Shiina et al. ..... 399/27
5,452,056 A 9/1995 Nomura et al.
5,528,341 A 6/1996 Shishido et al.
5,585,889 A 12/1996 Shishido et al.
5,822,647 A * 10/1998 Sakuraba et al. ..... 399/27
5,870,654 A 2/1999 Sato et al. ..... 399/109
5,911,096 A 6/1999 Batori et al. ..... 399/111
5,940,658 A 8/1999 Yokoi et al. ..... 399/119
5,946,522 A * 8/1999 Inami ..... 399/27
5,966,566 A 10/1999 Odagawa et al. ..... 399/109
5,974,288 A 10/1999 Sato ..... 399/119
5,987,269 A * 11/1999 Allen et al. ..... 399/27
6,075,957 A 6/2000 Batori et al. ..... 399/114

* cited by examiner

*Primary Examiner*—Sandra Brase
(74) *Attorney, Agent, or Firm*—Fitzpatrick, Cella, Harper & Scinto

(57) ABSTRACT

The present invention relates to a developer replenishing mechanism in which a developer replenishing apparatus is provided with a storing container containing a developer therein and capable of discharging the developer therefrom, and detachably attachable to a main body of the developer replenishing apparatus, and a carrying member provided in the storing container for carrying the developer. A control device interrupts the discharging operation of the storing container, and thereafter resumes the discharging operation of the storing container after the storing container is detached with respect to the main body of the developer replenishing apparatus and is again attached thereto, and thereafter inhibits the developing operation of the developing apparatus and interrupts the discharging operation of the storing container when it is detected at the second time by the detecting means that the driving load is not less than the predetermined value.

18 Claims, 14 Drawing Sheets

FIG. 14

EXXX

PLEASE PUT POWER SOURCE ON AGAIN

FIG. 15

PRINT IS POSSIBLE

100% 1 A4

REDUCE | 1 MAGNIFICATION | ENLARGE | SHEET SELECTION

ZOOM

LIGHTER | AUTOMATIC | DARKER

SORTER | BOTH FACES | CHARACTER | CHARACTER/ PHOTOGRAPH | PHOTOGRAPH

APPLICATION MODE

PLEASE SET TONER BOTTLE AGAIN

DEVELOPER REPLENISHING MECHANISM

BACKGROUND OF THE INVENTION

1. Field of the Invention

This invention relates to a developer replenishing mechanism having a developing apparatus for replenishing the developing apparatus with a developer.

2. Description of the Related Art

A developer replenishing apparatus for replenishing a developing device which is a developing apparatus for effecting the developing process with a developer has a developer bottle which is storing means (a storing container) storing the developer therein, and a carrying portion which is carrying means for carrying the developer supplied from the developer bottle to the developing device, and is designed to replenish the developing device with the stored developer in conformity with the consumption of the developer in the developing device resulting from the image forming operation.

The developer bottle is detachably attachable from the carrying portion, and it is possible to continue to replenish the developing device with the developer by detaching the developer bottle in which the developer has been consumed and attaching a new developer bottle.

Also, the supply of the developer from the developer bottle to the carrying portion is effected by rotating a supplying screw which is a developer carrying member provided in the developer bottle by driving means such as a motor to thereby discharge the developer from the developer bottle.

The driving means may have an abnormality such as an abnormal load monitored by abnormality detecting means which is load detecting means, and when an abnormal load or the like occurs, driving is stopped to thereby prevent the destruction of the driving means.

In such a developer replenishing apparatus, however, it is known that the inclination or solidification of the developer in the developer bottle occurs depending on a method of preserving the developer bottle, and when the inclination or solidification occurs, the rotational load of the supplying screw may increase and may sometimes exceed the amount of drivable load of the driving means.

In such cases, the abnormality detecting means detects abnormality and the driving by the driving means is stopped, whereby the problem of the destruction of the driving means is solved, but by the detection of this abnormality, an image forming apparatus assumes an operation-inhibited state (an operation-interrupted state), and for the user of the image forming apparatus, this has led to a remarkable reduction in work efficiency.

On the other hand, it is also known that the inclination or solidification of the developer as described above can be eliminated in most cases by once detaching the developer bottle from the carrying portion, and shaking the developer bottle, and thereafter attaching it again.

SUMMARY OF THE INVENTION

It is an object of the present invention to provide a developer replenishing mechanism in which when the inclination or solidification of a developer in a storing container occurs, the damage of the driving portion of a developer carrying member in the storing container is prevented.

It is another object of the present invention to provide a developer replenishing mechanism in which the time during which the developing operation of a developing apparatus is interrupted is shortened to thereby prevent any reduction in a user's work efficiency.

Other objects and features of the present invention will become more fully apparent from the following detailed description when read with reference to the accompanying drawings.

BRIEF DESCRIPTION OF THE DRAWINGS

FIG. 14 shows an example of the display by displaying means for displaying an abnormal condition.

FIG. 15 shows an example of the display by displaying means for displaying the inhibited condition of the replenishment of the developer supply from the bottle.

DESCRIPTION OF THE PREFERRED EMBODIMENTS

Embodiments of the present invention will hereinafter be described with reference to the accompanying drawings.

(First Embodiment)

A first embodiment of the present invention will first be described.

Figure 1:
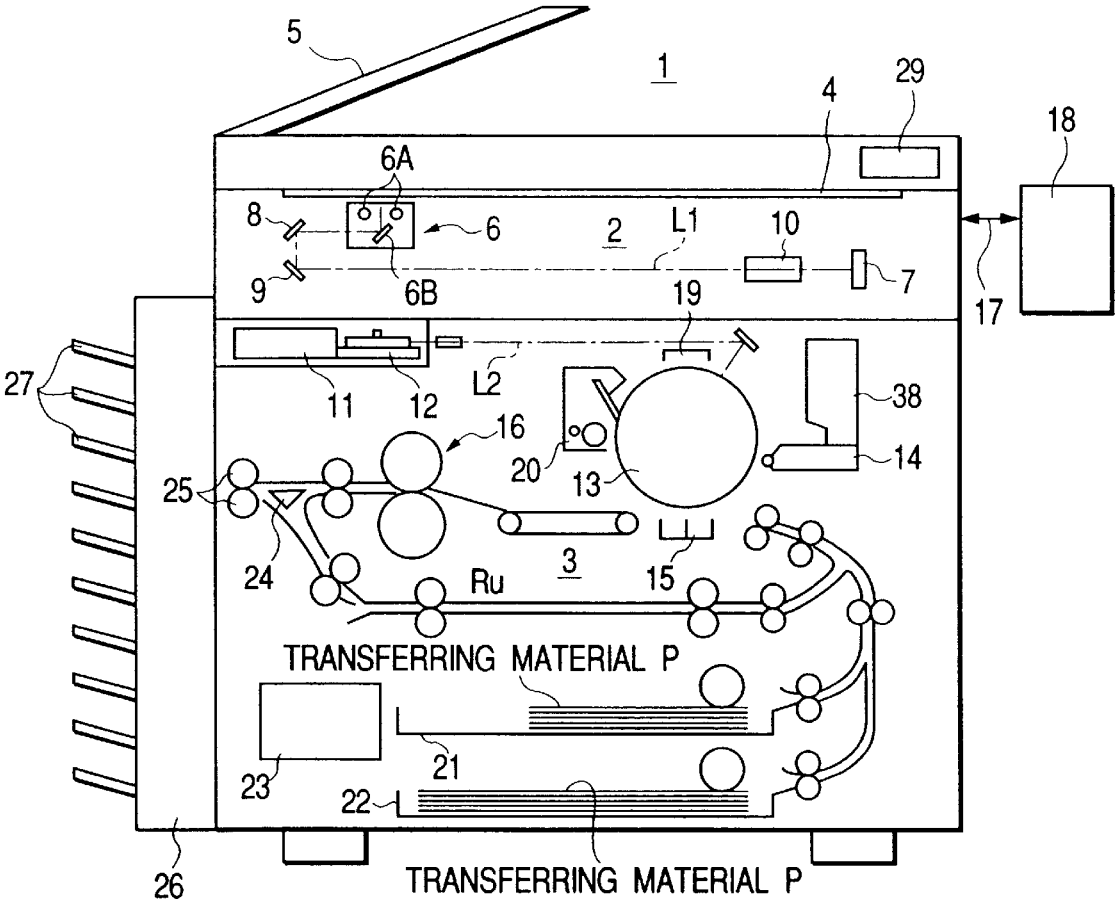
FIG. 1 is a cross-sectional view schematically showing the construction of a printer which is an image forming apparatus according to a first embodiment of the present invention.

A printer 1 which is an example suitably showing an image forming apparatus making the most of a developer replenishing mechanism in the present invention will hereinafter be described with reference to FIG. 1. FIG. 1 is a cross-sectional view schematically showing the construction of the printer 1.

The printer 1 is an image forming apparatus in a form for effecting the transferring process and the fixing process onto a transferring material P which is a sheet-like recording medium in accordance with the electrophotographic method or the electrostatic recording method or the like, and is divided into a reader portion 2 for reading given image information, and a printer portion 3 for transferring an image conforming to the read image information to the transferring material P, fixing the image on the transferring material P and recording the image.

The reader portion 2 in the printer 1 is provided with an original feeding apparatus 5 for feeding originals (not shown) which are image information providing sources one by one to a predetermined position on platen glass 4, a scanner unit 6 for exposing and scanning the image information of the original resting on the platen glass 4, and a CCD image sensor (hereinafter abbreviated as CCD) 7 for reading the received light image.

The scanner unit 6 provided in the reader portion 2 is supported for movement in a horizontal direction in the plane of the drawing sheet of FIG. 1 and a normal direction in the plane of the drawing sheet of FIG. 1, and is comprised of an exposure lamp 6A which is a light source and a mirror 6B, whereby a reflected light image L1 from the original obtained by the light emission of the exposure lamp 6A is condensed on the CCD 7 through the intermediary of the mirror 6B, mirrors 8, 9 and a lens 10.

On the other hand, the CCD 7 provided in the reader portion 2 is set so as to read the reflected light image L1 (analog data) obtained by the exposure of the exposure lamp 6A, and then convert it into image data (digital data) conforming to the read reflected light image L1 and output it, whereby the image data outputted from the CCD 7 is subjected to image processing along a pre-incorporated predetermined image processing sequence or the like, and thereafter is outputted to a laser driver 11 provided in the printer portion 3.

On the other hand, the printer portion 3 in the printer 1 is provided with a laser beam emitting portion 12 for modulating and emitting a laser beam L2 in conformity with the image data processed in the reader portion 2, by being driven by the laser driver 11, a photosensitive drum 13 which is a latent image bearing member having an endless outer peripheral surface for bearing an electrostatic latent image, a developing apparatus 14 which is developing means for effecting the developing process, a transferring and separating charger 15 for effecting the transferring process, etc., and a fixing apparatus 16 for effecting the fixing process by supplying heat and imparting pressure.

The laser beam emitting portion 12 provided in the printer portion 3 is a unit driven by the laser driver 11 to thereby modulate and emit the laser beam L2, thereby exposing the outer peripheral surface of the photosensitive drum 13 to form an electrostatic latent image conforming to the image information given onto the outer peripheral surface of the photosensitive drum 13, and in the present embodiment, the original placed at the predetermined position on the platen glass 4 by the original feeding apparatus 5 serves as an image information providing source to the laser beam emitting portion 12.

On the other hand, around the photosensitive drum 13 provided in the printer portion 3, there are disposed a primary charger 19 for distributing on the outer peripheral surface of the photosensitive drum 13 a predetermined potential distribution in advance at predetermined timing to thereby prepare for the exposure from the laser beam emitting portion 12, the developing device 14, the transferring and separating charger 15 and a cleaner 20 for removing any residual on the outer peripheral surface of the photosensitive drum 13 after the transferring process by the transferring and separating charger 15.

The transferring and separating charger 15 disposed around the photosensitive drum 13 is a unit making the most, for example, of conventional corona discharge or the like to thereby effect the transferring process onto the transferring material P conveyed from a sheet feeding cassette 21 or 22 detachably attachably supported on the printer 1, and thereafter separating the transferring material P subjected to the transferring process from the outer peripheral surface of the photosensitive drum 13.

In the printer 1 of the above-described construction, a control sequence or the like is set up so that the process from the formation of the electrostatic latent image conforming to the image information to the fixing of the image onto the transferring material P may be done in the following manner.

In the printer 1, the laser beam L2 conforming to the image information provided from the original resting at the predetermined position on the platen glass 4 is first modulated and emitted from the laser beam emitting portion 12 by the driving of the laser driver 11, whereby the outer peripheral surface of the photosensitive drum 13 subjected in advance to the potential distribution setting by the primary charger 19 is exposed, whereby an invisible image, i.e., a so-called electrostatic latent image, conforming to the given image information is formed on the outer peripheral surface of the photosensitive drum 13.

Next, the photosensitive drum 13 on the outer peripheral surface of which the electrostatic latent image has been formed is subjected to the developing process by a developer being imparted thereto from the developing apparatus 14 at predetermined timing, whereby a visible image, i.e., a so-called developer image, conforming to the given image information is formed on the outer peripheral surface of the photosensitive drum 13, whereafter the developer image is transferred onto the transferring material P conveyed from one of the sheet feeding cassettes 21 and 22, by the transferring and separating charger 15.

Further, by the supply of heat and the imparting of pressure from the fixing apparatus 16 to the transferring material P to which the developer image has been transferred (hereinafter the developer image transferred to the transferring material P will be referred to as the unfixed image), the unfixed image is melted and fixed on the transferring material P.

Consequently, in the printer 1, (1) when the image forming process onto only one surface of the transferring material p is being executed, the transferring material p subjected to the fixing process on one surface thereof is conveyed to sheet discharging rollers 25 by a flapper 24 provided in the printer 1, whereby it is discharged out of the printer 1. On the other hand, (2) when the image forming process onto the both surfaces of the transferring material p is being executed, the transferring material p subjected to the fixing process on only one surface thereof is re-conveyed to the transferring area between the photosensitive drum 13 and the transferring and separating charger 15 by the flapper 24 and the sheet discharging rollers 25 via a re-conveying path Ru. On the other hand, the transferring material P subjected to the fixing process on the both surfaces thereof is conveyed to the sheet discharging rollers 25 by the flapper 24, whereby it is discharged out of the printer 1. Also, (3) when the continuous image forming process onto one surface or both surfaces of each of a plurality of transferring materials p is being executed, the transferring materials p subjected to the fixing process on one surface or both surfaces thereof are sorted and discharged to a plurality of bins 27 provided on one side of the printer 1, by the flapper 24 and a sorter 26.

The developing apparatus 14 and a developer replenishing apparatus 38 provided in the printer 1 for replenishing the developing apparatus 14 with the developer will now be described with reference to FIGS. 3 and 4.

A developer replenishing mechanism is provided with the developing apparatus 14 and the developer replenishing apparatus 38.

Figure 3:
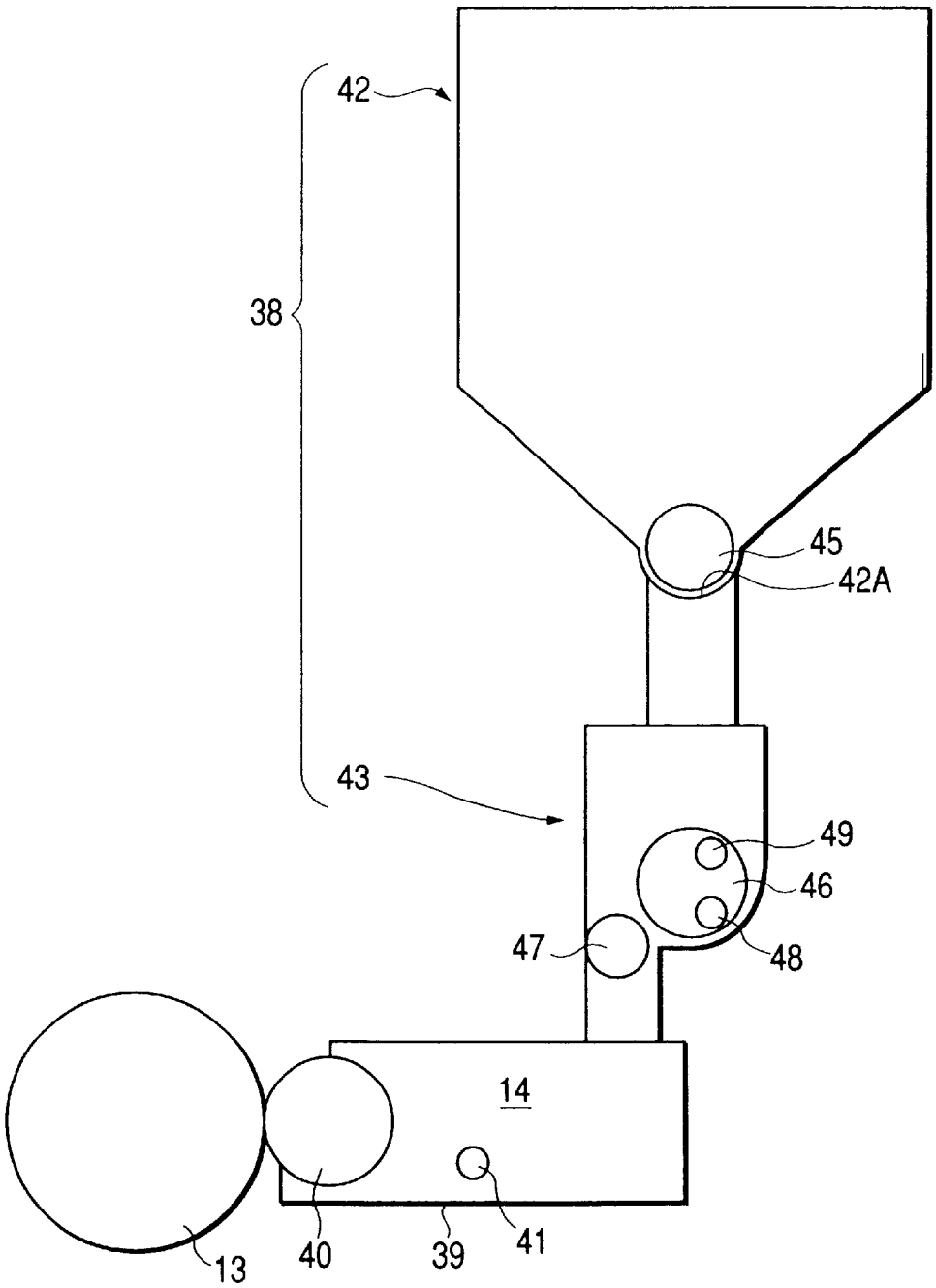
FIG. 3 is a typical cross-sectional view schematically showing the constructions of a developing apparatus and a developer replenishing apparatus provided in the image forming apparatus shown in FIG. 1.
Figure 4:
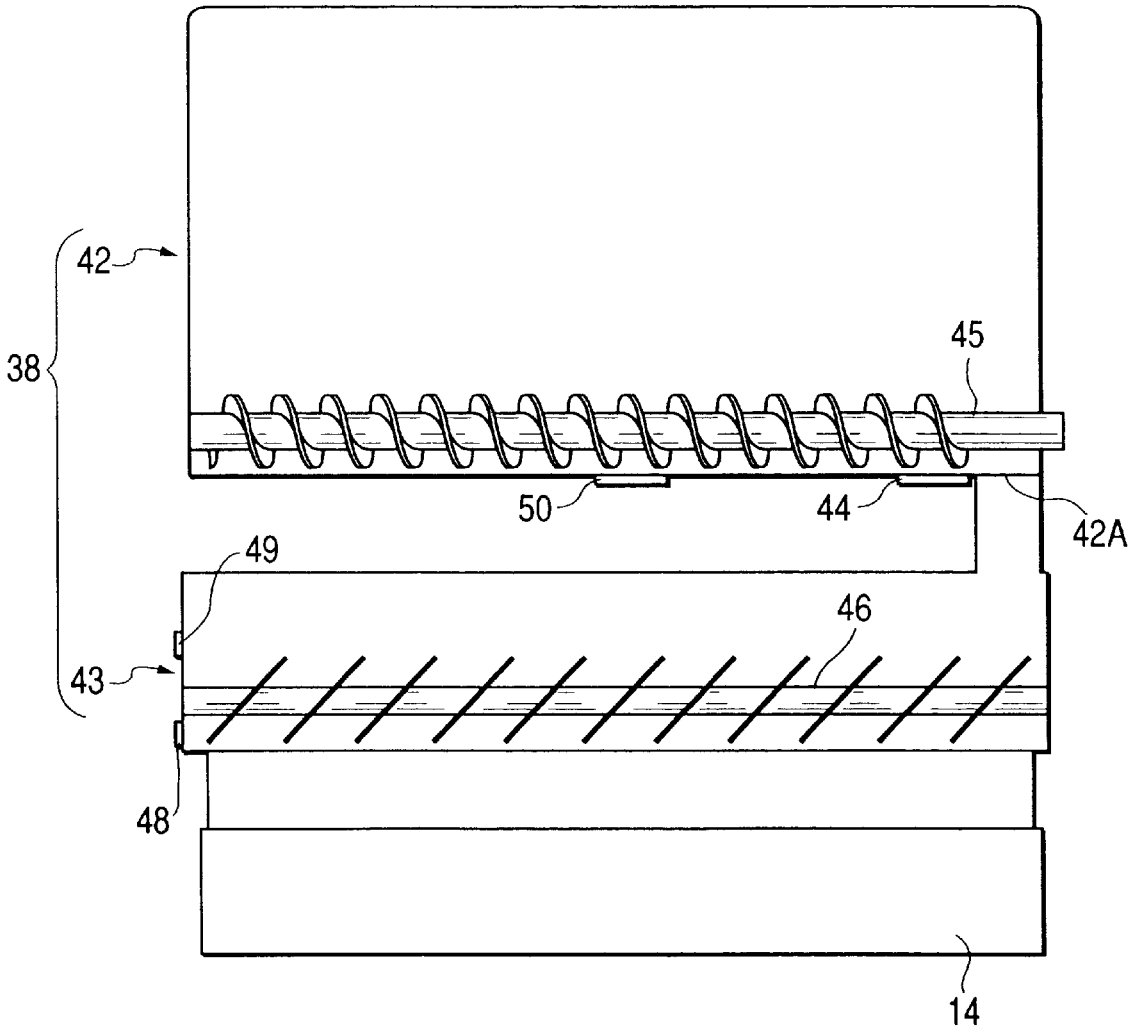
FIG. 4 is a typical cross-sectional view of the developing apparatus and the developer replenishing apparatus shown in FIG. 3 as they are seen from their sides.

FIG. 3 is a typical cross-sectional view schematically showing the constructions of the developing apparatus 14 and the developer replenishing apparatus 38, and FIG. 4 is a typical cross-sectional view of the developing apparatus 14 and the developer replenishing apparatus 38 shown in FIG. 3 as they are seen from the sides thereof.

The developing apparatus 14, as shown in FIG. 3, has a developer containing portion 39 for containing therein the developer replenished from the developer replenishing apparatus 38, and a cylindrical or column-shaped developing sleeve 40 which is a developer carrying member having an endless outer peripheral surface for carrying the developer thereon.

The developer containing portion 39 of the developing apparatus 14 is provided with a sensor 41 which is first developer amount detecting means for detecting the amount of contained developer, and the sensor 41 is set so as to output a signal corresponding to the obtained result of detection to a control portion 23 which is control means.

On the other hand, the developing sleeve 40 of the developing apparatus 14 is rotatably journalled to the developer containing portion 39, and is rotatively driven by a driving mechanism (not shown) provided in the printer 1 during development to thereby carry the developer carried on the outer peripheral surface thereof by an electrostatic force or a magnetic force to the electrostatic latent image formed on the outer peripheral surface of the photosensitive drum 13.

On the other hand, the developer replenishing apparatus 38, as shown in FIG. 4, is provided with a replenishing container (hereinafter simply referred to as the bottle) 42 which is a storing container capable of discharging the developer, and a carrying device 43 which is a carrying unit for carrying the developer to the developing apparatus 14.

In the bottle 42 provided in the developer replenishing apparatus 38, as shown in FIG. 4, a shutter 44 for opening and closing a discharge port 42A for discharging the stored developer downwardly in the plane of the drawing sheet is supported for movement in the left to right direction in the plane of the drawing sheet, and a supplying screw 45 for smoothing the discharge of the developer from the discharge port 42A is rotatably journalled.

Also, the bottle 42 is attachable to the carrying device 43, whereby as shown in FIG. 4, the bottle 42 is attached to the carrying device 43 while being moved from left to right, whereby the shutter 44 which has so far closed the discharge port 42A slides from right to left and opens the discharge port 42A, and the discharge of the developer from the bottle 42 to the carrying device 43 becomes possible. Also, the attachment and detachment of the bottle 42 are detected by an attachment/detachment detecting switch 50.

On the other hand, the carrying device 43 provided in the developer replenishing apparatus 38, as shown in FIG. 3, carries the developer supplied from the bottle 42 from right to left, and an agitating screw 46 which is agitating means is rotatably journalled to moderately agitate the developer stored in the device, and as shown in FIG. 4, two sensors 48 and 49 which are second developer detecting means for the detection of the amount of developer adopted at different detection levels are provided on the left side as viewed in the plane of the drawing sheet.

The agitating screw 46 performs its rotating operation when the developer is supplied from the bottle 42 to the carrying device 43 and from the carrying device 43 to the developer containing portion 39.

A falling screw 47 is also rotated when the developer is supplied from the carrying device 43 to the developer containing portion 39.

As the sensors 48 and 49 provided in the carrying device 43, in the present embodiment, use is made of detecting elements to which the conventional piezoelectric effect is applied, i.e., piezo sensors which are detecting elements making a response conforming to pressure imparted thereto.

In the present embodiment, the installed position of the sensor 48 is set more adjacent to the bottom surface of the carrying device 43 than the installed position of the sensor 49 in order to detect the presence or absence of the developer in the carrying device 43 by the sensor 48 and on the other hand, detect by the sensor 49 whether the amount of developer stored in the carrying device 43 has reached a predetermined amount or greater.

Also, the sensors 48 and 49 may sometimes be in a state in which pressure is not imparted thereto when the developer is stationary even if the developer is stored in the carrying device 43, and the outputs of the sensors 48 and 49 when the developer in the carrying device 43 is being agitated by the agitating screw 46 are detected to thereby detect whether the amount of developer stored in the carrying device 43 has reached the predetermined amount or greater.

Consequently, in the present embodiment, the discharge of the developer from the bottle 42 to the carrying device 43 is continued until the result of the detection indicating that the amount of developer stored in the carrying device 43 has reached the predetermined amount or greater is outputted from the sensor 49.

That is, at a time soon after the discharge of the developer from the bottle 42 to the carrying device 43 has been started, as shown in FIG. 4, the developer discharged from the discharge port 42A is carried from right to left while being agitated by the agitating screw 46 and therefore, pressure is not imparted from the surrounding developer only to the sensor 48, whereby the result of the detection indicating that the developer is present in the carrying device 43 is only outputted from the sensor 48.

However, by the discharge of the developer from the bottle 42 to the carrying device 43 being done to a certain degree, pressure is imparted from the surrounding developer to the sensor 48 and the sensor 49, whereby the result of the detection indicating that the amount of developer stored in the carrying device 43 has reached the predetermined amount or greater is outputted from the sensor 49.

Also, even when the developer stored in the carrying device 43 is not uniform due to differences in temperature, humidity, etc., the developer stored in the carrying device 43 is agitated for a predetermined time by the agitating screw 46 after the termination of the replenishment from the bottle 42 so that the developer containing portion 39 can be uniformly replenished with a distribution.

A control portion 23 which is control means shown in FIG. 1 will now be described with reference to FIG. 2 which is a typical block diagram schematically showing the construction thereof.

The control portion 23 effects all kinds of control of the printer 1, but in FIG. 2, only the portions concerned with the present invention will be described. The other kinds of control of the printer 1 are carried out with the conventional technique. Accordingly, the latent image formation in the present embodiment is carried out with the conventional technique.

Figure 2:
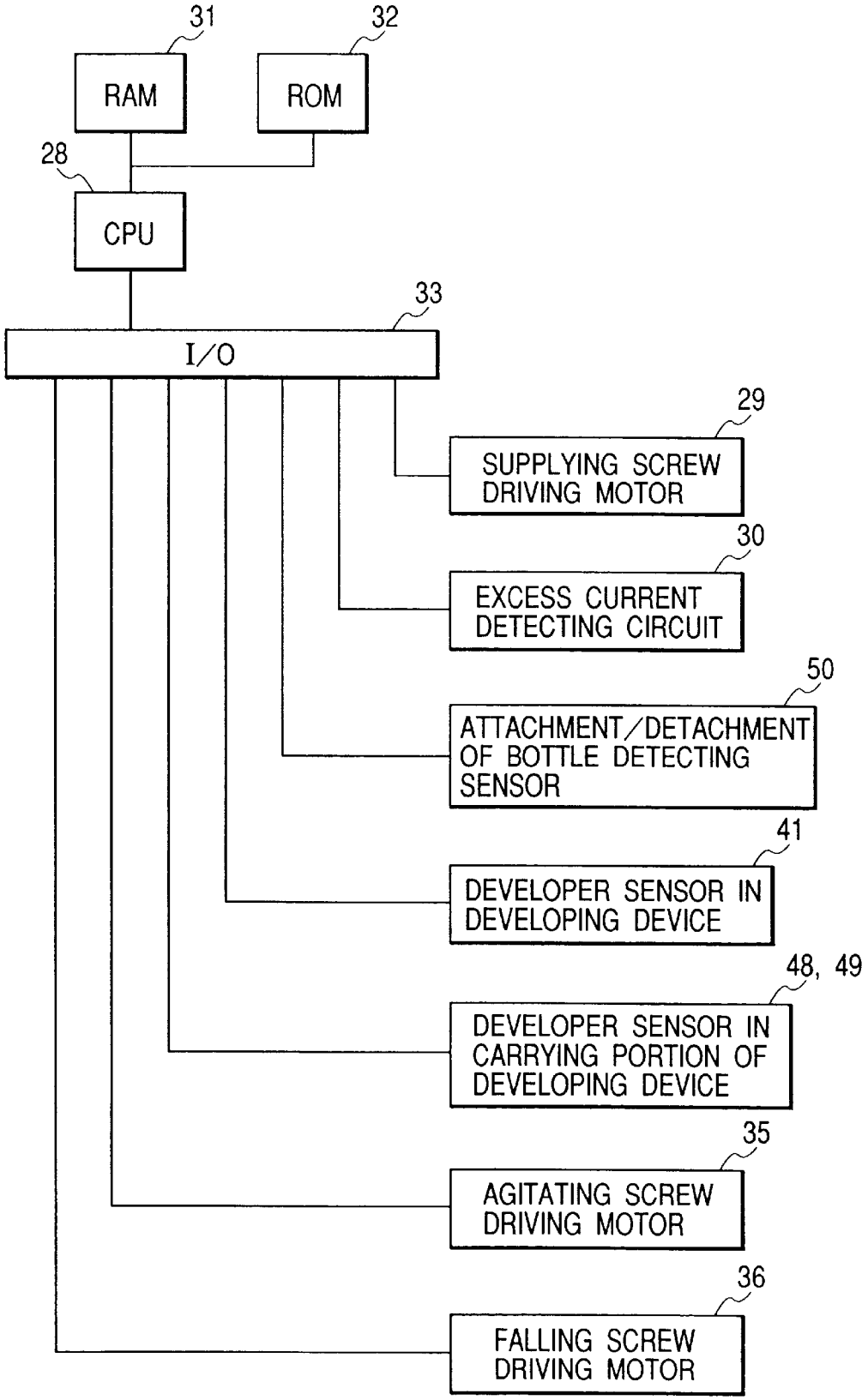
FIG. 2 is a block diagram schematically showing the construction of control means provided in the image forming apparatus shown in FIG. 1.

In FIG. 2, the reference numeral 28 designates a CPU which effects the control of each portion of the printer 1.

The reference numeral 31 denotes a RAM which is memory means capable of reading and writing for storing the control data of the CPU 28 and an error occurrence flag which will be described later.

The reference numeral 32 designates a ROM storing a control program of CPU 28 therein.

The reference numeral 33 denotes the input/output interface (I/F) of the CPU 28, and the exchange of input and output signals is effected through this I/F.

The reference numeral 29 designates a driving motor for driving a supplying screw 45 which is a developer carrying member for effecting the discharge of the developer from the bottle 42 which is storing means, and by effecting the ON/OFF thereof, the replenishment of the developer supply is effected from the developer bottle to the carrying device.

The reference numeral 30 denotes an excess current detecting circuit which is load detecting means for detecting the abnormality of the load of the driving motor 29 which is a driving portion for the supplying screw 45, and it inputs an abnormality detection signal to the input/output interface 33 when a current exceeding a predetermined consumption current flows.

While in the present embodiment, the excess current detecting circuit 30 is used as the load detecting means (abnormality detecting means), this may be replaced by a method of detecting the rotation of the supplying screw 45 by an encoder or the like, and detecting abnormality when a reduction in the number of rotations or the rise of the irregularity of rotation deviates from a predetermined range.

The reference numeral 50 designates an attachment/detachment detecting sensor which is attachment/detachment detecting means for detecting the attached and detached states of the bottle 42 and the carrying device 43, and specifically, it is comprised of a photosensor, a microswitch or the like.

The reference numeral 41 denotes a sensor which is a first developer detecting means installed in the developing apparatus 14 shown in FIGS. 3 and 4.

The reference numerals 48 and 49 designate sensors which are second developer detecting means for detecting the presence or absence of the developer in the carrying device 43. When the developer cannot be detected even if the replenishing operation from the bottle 42 to the carrying device 43 is performed for a predetermined time, it is judged that the developer is absent in the bottle 42.

The reference numeral 35 designates a motor for driving the agitating screw 46, and the reference numeral 36 denotes a motor for driving the falling screw 47 for effecting the carrying of the developer in the carrying device 43 which is carrying means.

While in the present embodiment, the agitating screw 46 and the falling screw 47 are driven by the discrete motors, the driving of the screws can also be realized by adopting a construction in which the driving of the motor for driving the agitating screw is transmitted to the falling screw by a clutch.

A method of realizing the control means in the present invention will now be described with reference to FIGS. 5 to 8.

Figure 5:
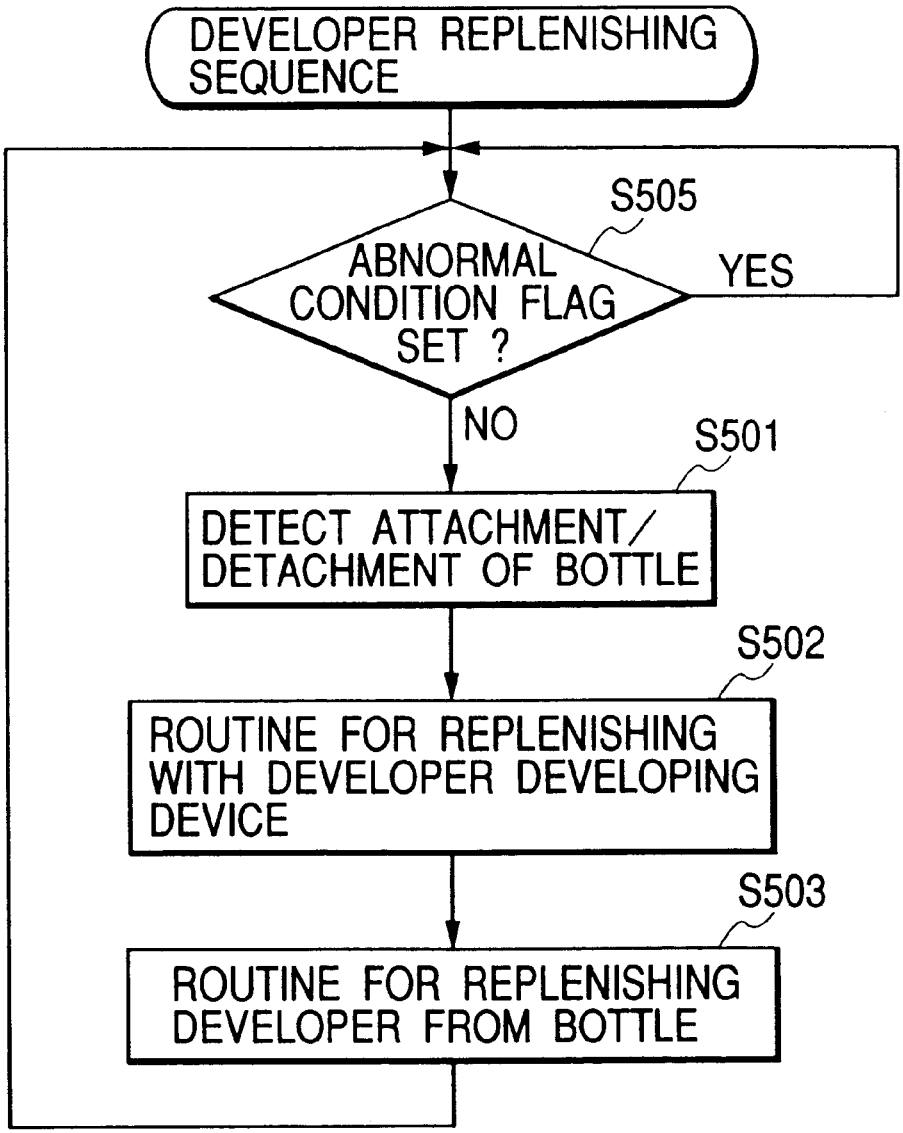
FIG. 5 is a flow chart for illustrating the control of a developing apparatus, carrying means and storing means, of the control of control means in a second embodiment of the present invention.

FIG. 5 is a flow chart representing the control of the developing apparatus 14, the carrying device 43 and the bottle 42, of the control by the control means in the present invention.

First, at S505, whether an abnormal condition flag is set is examined, and if the flag is set, control is effected in no way, and if the flag is not set, advance is made to S501.

Next, at S501, attachment/detachment of bottle detection which is a subroutine for detecting the attachment and detachment of the bottle 42 to and from the carrying device 43 is carried out.

Next, at S502, a routine for replenishing the developing device with the developer which is a subroutine for replenishing the developing apparatus 14 with the developer from the carrying device 43 is carried out.

Lastly, at S503, a routine for replenishing with the developer from the bottle which is a subroutine for replenishing the carrying device 43 with the developer from the bottle 42 is carried out.

After S503 has been carried out, return is made to S501, and the subroutines are successively carried out again from the attachment/detachment of bottle detection.

Figure 6:
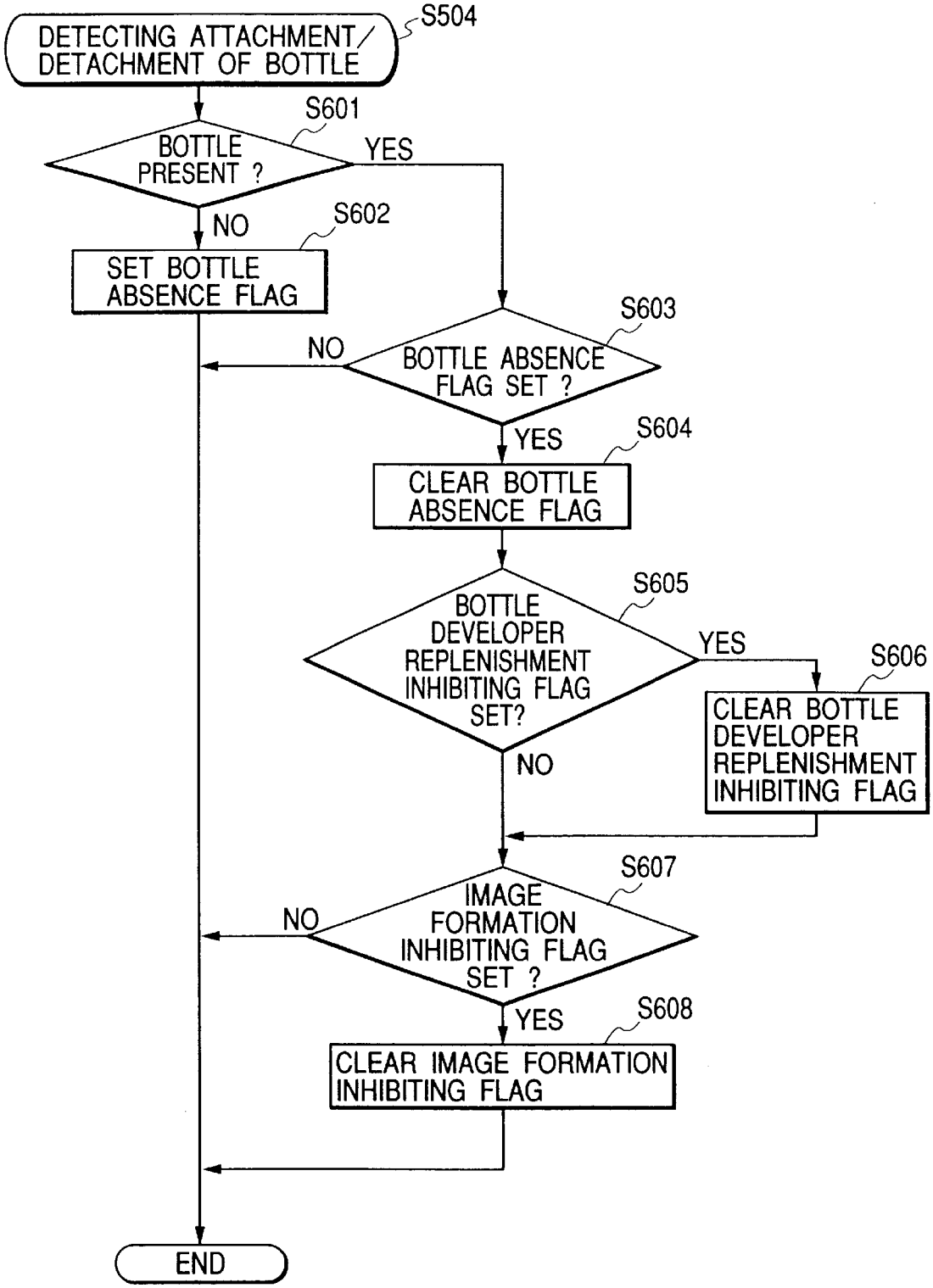
FIG. 6 is a flow chart illustrating the substance of a subroutine for detecting the attachment/detachment of a bottle at S501 shown in FIG. 5.

FIG. 6 is a flow chart illustrating the substance of the attachment/detachment of bottle detecting subroutine of S501 of FIG. 5.

This attachment/detachment of bottle detecting subroutine first examines the ON/OFF of the attachment/detachment detecting sensor 50 at S601. When the attachment/detachment detecting sensor 50 detects the absence of the bottle, advance is made to S602.

At S602, a developer bottle absence flag is set, and the subroutine is ended. This developer bottle absence flag is stored in the RAM 31 described in connection with FIG. 2.

On the other hand, when the attachment/detachment detecting sensor 50 detects the presence of the bottle, advance is made to S603.

At S603, the bottle absence flag set at S602 is read out, and if this flag is set, it means the change from a condition in which the bottle 42 is detached to a condition in which the bottle 42 has been detected as being attached, that is, the bottle absence to bottle presence edge has been detected and therefore, advance is made to S604, where the bottle absence flag is cleared, and advance is made to S605.

On the other hand, if at S603, the developer bottle absence flag is not set, it is not the attachment/detachment edge of the developer bottle and therefore, the subroutine is ended.

At S605, a bottle developer replenishment inhibiting flag is read out, and if this flag is set, advance is made to S606, where the bottle developer replenishment inhibiting flag is cleared, and advance is made to S607. This bottle developer replenishment inhibiting flag is read out and set at the subroutine of FIG. 8.

The operation of replenishing the carrying device 43 with the developer from the bottle 42 is inhibited as will be described later with reference to FIG. 8 while this bottle developer replenishment inhibiting flag is set.

On the other hand, if at S605, the bottle developer replenishment inhibiting flag is not set, advance is made to S607.

At S607, an image formation inhibiting flag stored in the RAM 31 is read out, and if this flag is not set, the subroutine is ended.

On the other hand, if at S607, the image formation inhibiting flag is set, advance is made to S608, where the image formation inhibiting flag is cleared, and the subroutine is ended. This image formation inhibiting flag is read out in the subroutine of FIG. 8, and if the flag is set, the image forming operation stops being performed.

Figure 7:
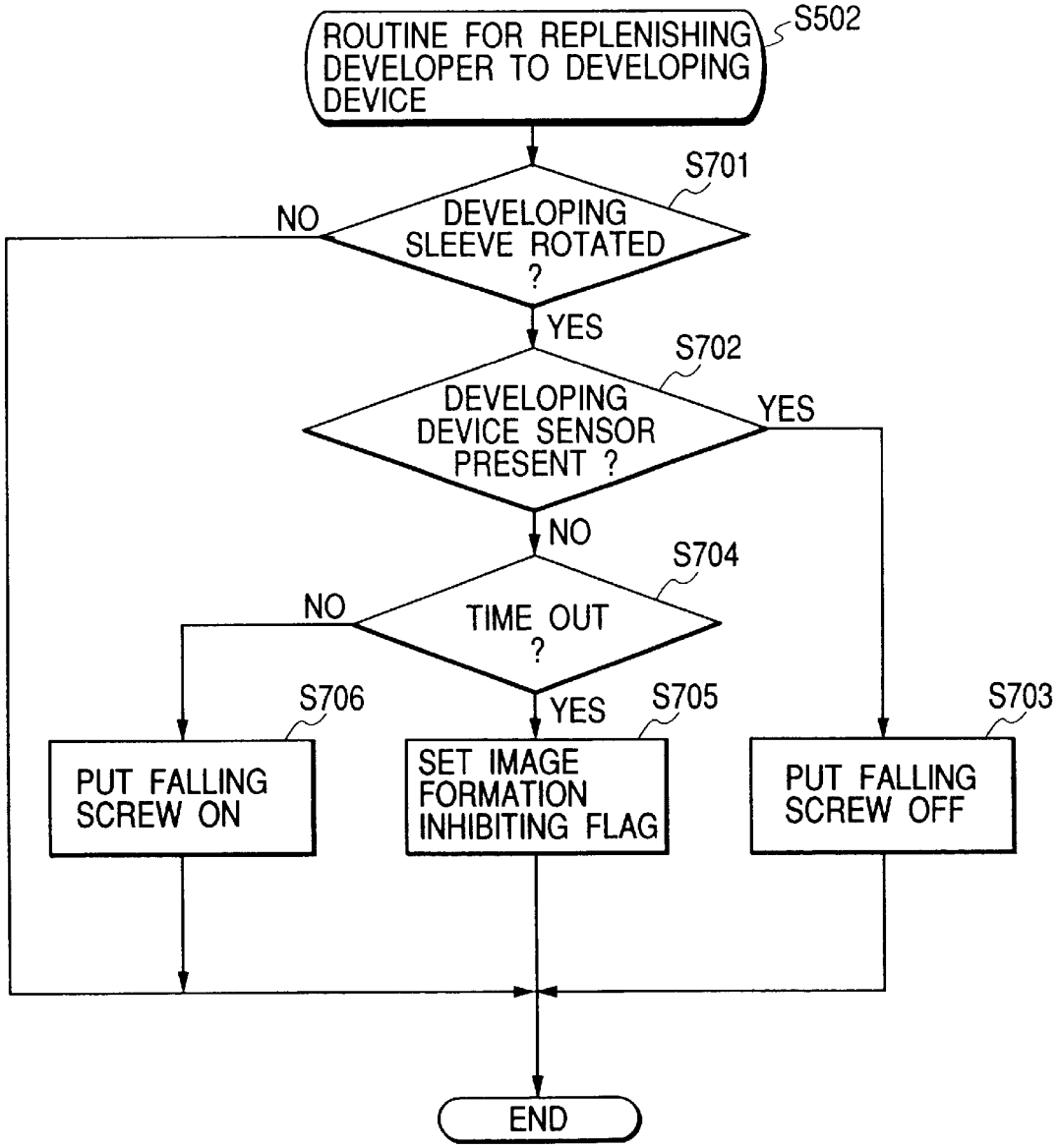
FIG. 7 is a flow chart illustrating the detailed substance of a subroutine for replenishing a developing device with a developer at S502 shown in FIG. 5.

The detailed description of S502 of FIG. 5 will now be made with reference to the flow chart of FIG. 7.

First, at S701, whether the developing sleeve 40 is being rotated is examined. If the developing sleeve 40 is not being rotated, the developer is not consumed and therefore, the developer is not replenished. Therefore, the developing device developer replenishing routine is ended.

On the other hand, if the developing sleeve 40 is being rotated, advance is made to S702.

At S702, the sensor 41 of the developing apparatus 14 is examined, and if the sensor 41 of the developing apparatus 14 has detected the presence of the developer, the operation of replenishing the developing apparatus with the developer from the carrying device 43 is unnecessary and therefore, advance is made to S703, where the falling screw 47 is put off, and the subroutine is ended.

On the other hand, if at S702, the sensor 41 of the developing apparatus 14 has detected the absence of the developer, the operation of replenishing the developing apparatus 14 with the developer from the carrying device 43 is necessary and therefore, advance is made to S704.

At S704, the time for which the sensor 41 of the developing apparatus 14 continuously detects the absence of the developer is measured, and if the sensor 41 of the developing apparatus 14 detects the absence of the developer for a predetermined time, advance is made to S705, where the image formation inhibiting flag is set. When the image formation inhibiting flag is set, the image forming operation stops being performed. Therefore, the rotation of the developing sleeve 40 is stopped, and this subroutine comes to put the falling screw 47 off.

On the other hand, if at S704, it is judged that a predetermined time has not elapsed, advance is made to S706, where the falling screw 47 is put on, and the operation of replenishing the developing apparatus 14 with the developer from the carrying device 43 is performed.

Thus, in the developing device developer replenishing routine described with reference to FIG. 7, the driving of the falling screw 47 is put on/off in conformity with the detection/non-detection of the developer by the sensor 41 of the developing apparatus 14, and when the sensor 41 cannot detect the developer even if the falling screw 47 is driven for a predetermined time, the image formation inhibiting flag directed to the inhibition of the image forming operation is set.

The detailed description of S503 shown in FIG. 5 will now be made with reference to the flow chart of FIG. 8.

First, at S801, the developer replenishment inhibiting flag stored in the RAM 31 is read out, and if this flag is set, it means a developer replenishment inhibiting condition and therefore, advance is made to S813, where the driving of the agitating screw 46 and the supplying screw 45 is put off, and the subroutine is ended. This developer replenishment inhibiting flag is set in the present subroutine, and is cleared at S606 of the attachment/detachment of bottle detecting subroutine described with reference to FIG. 6.

If at S801, the developer replenishment inhibiting flag is not set, it means a developer replenishment permitting condition and therefore, advance is made to S802.

At S802, whether the sensor 49 of the carrying device 43 has detected the developer or not is examined, and if it has detected the developer, it is unnecessary to replenish with the developer and therefore, advance is made to S813, where the driving of the agitating screw 46 and the supplying screw 45 is put off, and the subroutine is ended.

On the other hand, if at S802, the sensor 49 of the carrying device 43 has not detected the developer, advance is made to S803.

At S803, whether the condition in which the developer is not detected has not continued for a predetermined time or longer is examined, and if the predetermined time or longer has elapsed, it is judged that the developer is absent in the bottle 42, and advance is made to S805.

At S805, the error occurrence flag is cleared, and advance is made to S806.

At S806, the bottle developer replenishment inhibiting flag is set.

At S805, the error occurrence flag is stored in the RAM 31, and is a flag for recording that abnormality has occurred to the driving motor 29 for the supplying screw 45.

On the other hand, if at S803, the absent state of the developer has not been detected for a predetermined time, advance is made to S804.

At S804, the driving of the agitating screw 46 and the supplying screw 45 is put on, and the carrying device 43 is replenished with the developer from the bottle 42. Next, advance is made to S807.

At S807, the subroutine is ended if the excess current detecting circuit 30 has not detected an excess current.

On the other hand, when at S807, the excess current is detected, advance is made to S808, where the error occurrence flag stored in the RAM 31 is read out, and advance is made to S809.

At S809, the error occurrence flag read out at S808 is examined, and if it is already set, it means the second detection of the excess current and therefore, advance is made to S810, where an abnormal condition flag is set. Image formation is inhibited while this flag is set.

On the other hand, if at S809, the error occurrence flag is not set, it means the first excess current detection and therefore, advance is made to S811, where the error occurrence flag is set, and advance is made to S812. At S812, the bottle developer replenishment inhibiting flag is set, and the operation of replenishing the carrying device 43 with the developer from the bottle 42 is inhibited. After S810 and S812 have been processed, advance is made to S813, where the driving of the agitating screw 46 and the supplying screw 45 is put off, and the replenishing of the carrying device 43 with the developer from the bottle 42 is stopped.

As described above, in the bottle developer replenishing subroutine, the ON/OFF of the driving of the agitating screw 46 and the supplying screw 45 is controlled in conformity with the presence or absence of the detection of the developer by the sensor 49 of the carrying device 43, and if the sensor 49 of the carrying device 43 cannot detect the developer for a predetermined time, it is judged that the developer is absent in the bottle 42.

Further, when during the driving of the supplying screw 45, the excess current of the driving motor 29 is detected in the supplying screw 45 and when the detection of the excess current is the second detection of the excess current, the image forming operation is inhibited, and when the detection of the excess current is the first detection of the excess current, the bottle developer replenishing operation is inhibited. In this latter case, the image forming operation is possible until the developer supplied into the carrying device 43 becomes null.

Also, the bottle developer replenishment inhibiting flag set in the present subroutine, as described with reference to FIG. 6, is not cleared unless the attaching/detaching operation of the bottle 42, i.e., the operation of detaching the bottle 42 from the carrying device 43 and again setting it, is performed.

Further, the error occurrence flag set in the present subroutine is not cleared unless it is judged that the developer has become null in the bottle 42. This is because when the excess current is detected again before a bottle is used up, it is judged that the cause of the excess current having flowed is not the inclination or solidification of the developer in the bottle 42, but the abnormality of the driving motor 29 itself driving the supplying screw 45.

(Second Embodiment)

A second embodiment of the present invention will now be described. In the second embodiment, members similar in construction to those in the first embodiment are given the same reference numerals and need not be described.

A typical block diagram schematically representing the construction of the controlling portion 23 which is control means in the present embodiment will first be described with reference to FIG. 9. The block in the dotted line of FIG. 9 is similar to that of FIG. 2 and therefore need not be described.

Figure 9:
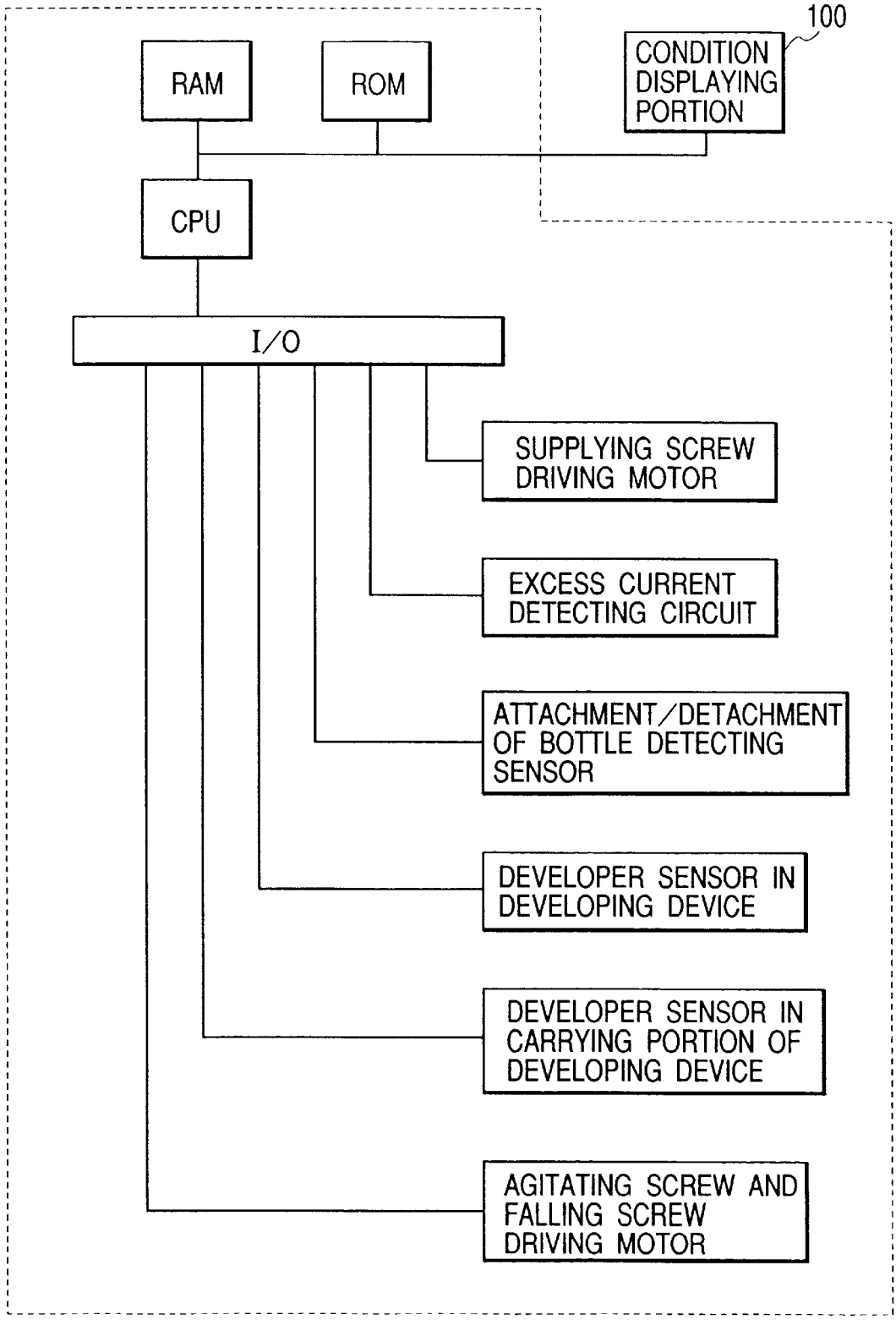
FIG. 9 is a typical block diagram schematically showing the construction of control means in the second embodiment of the present invention.

In FIG. 9, the reference numeral 100 designates a condition displaying portion which is displaying means, and in the present embodiment, it is realized by the use of an LCD (liquid crystal display). Of course, use may be made of other displaying apparatus such as a CRT (cathode ray tube) display or a plasma display.

The control of the developing apparatus 14, the carrying device 43, the bottle 42 and the condition displaying portion 100 by the controlling portion 23 in the present embodiment will now be described with reference to FIG. 10.

Figure 10:
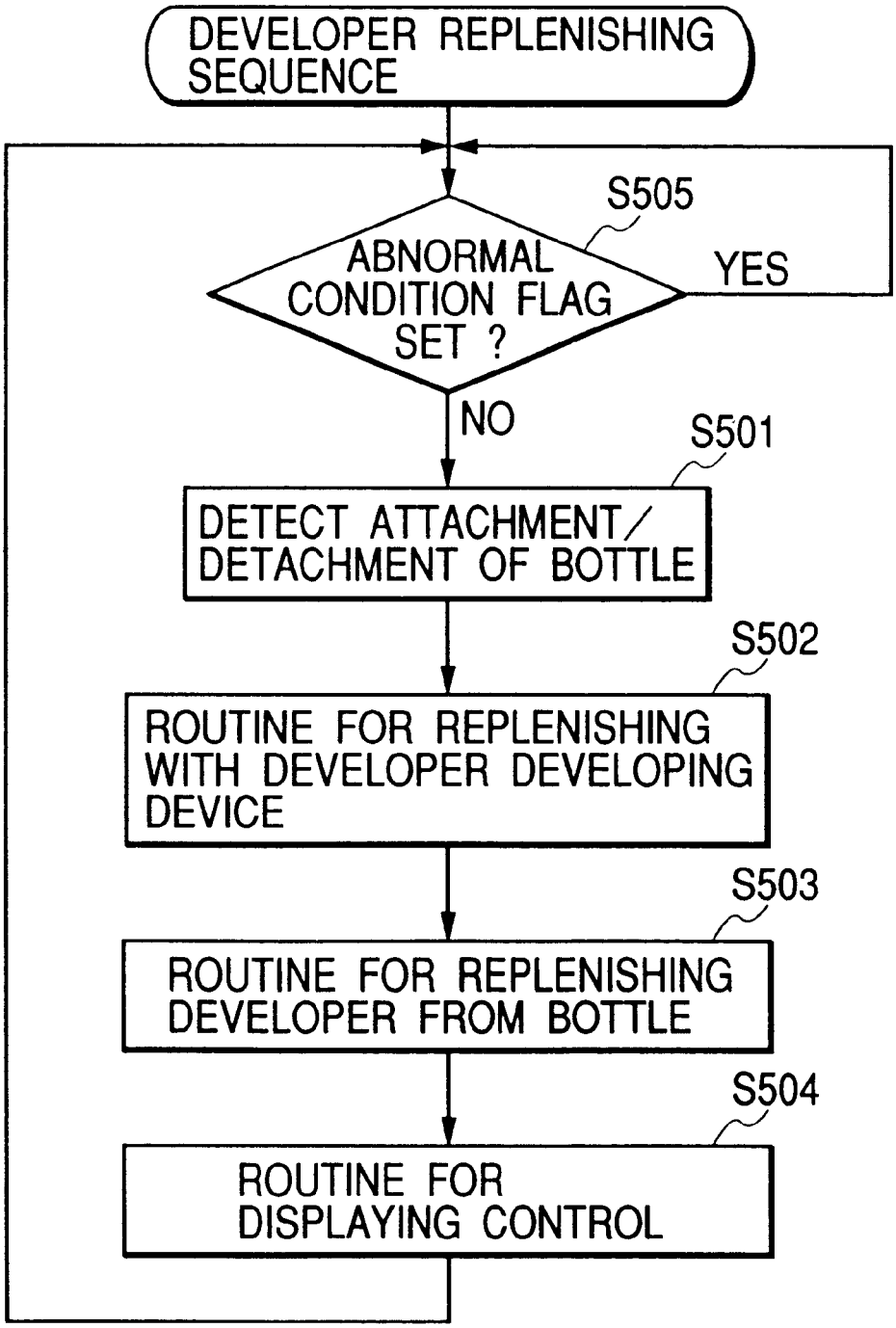
FIG. 10 is a flow chart for illustrating the control of a developing apparatus, carrying means, storing means and displaying means in the control means shown in FIG. 9.

S501 to S503 and S505 in FIG. 10 are the same as S501 to S503 and S505 in FIG. 5 and therefore need not be described.

At S504, the display of conditions conforming to the conditions of the image formation inhibiting flag and the bottle developer replenishment inhibiting flag described with reference to FIGS. 5 to 8 is effected in the condition displaying portion 100.

Figure 11:
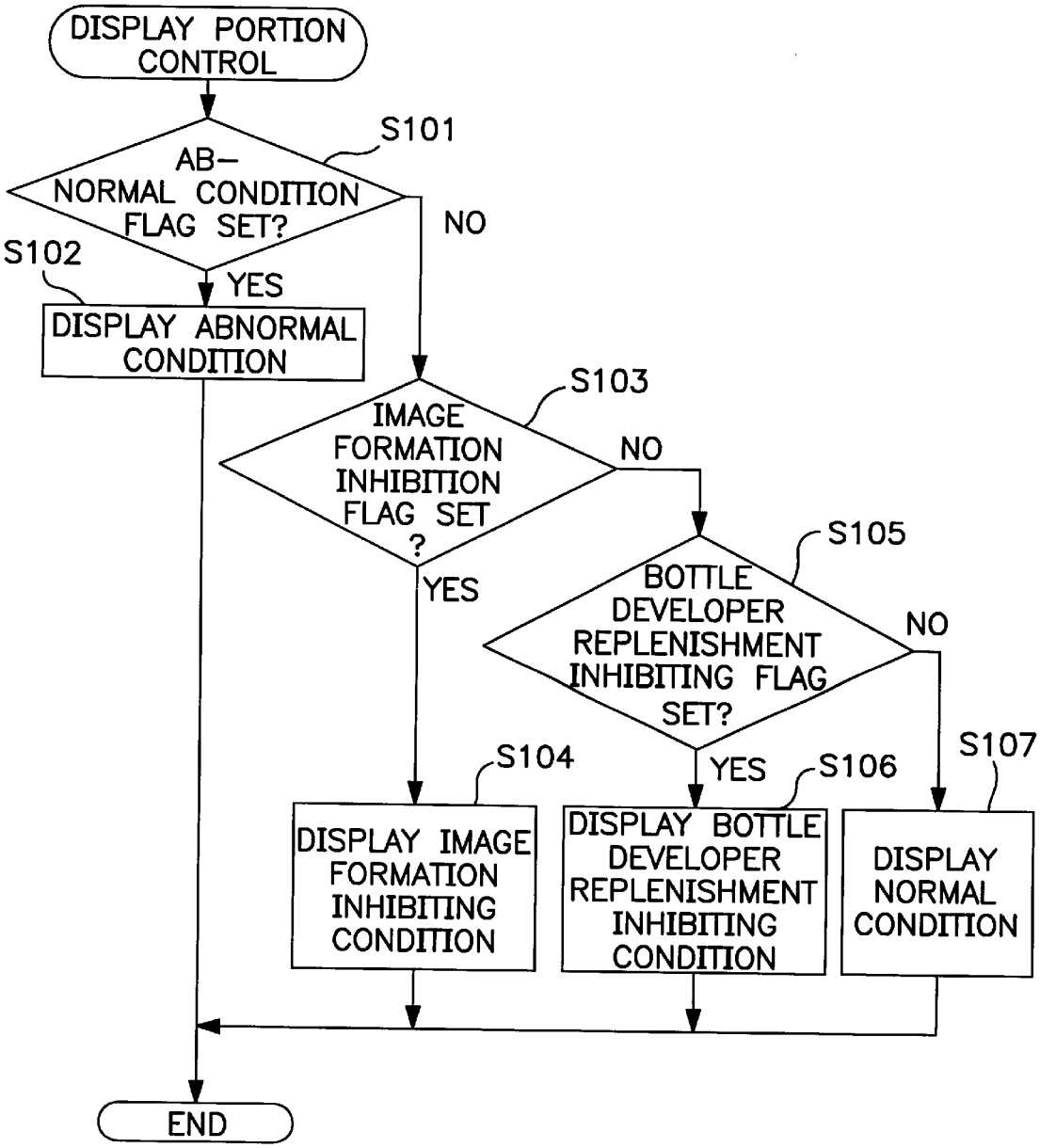
FIG. 11 is a flow chart for illustrating the detailed substance of a display control routine S504 shown in FIG. 9.

The control procedure of the display of the condition in the condition displaying portion 100 will now be described with reference to a flow chart shown in FIG. 11.

Figure 8:
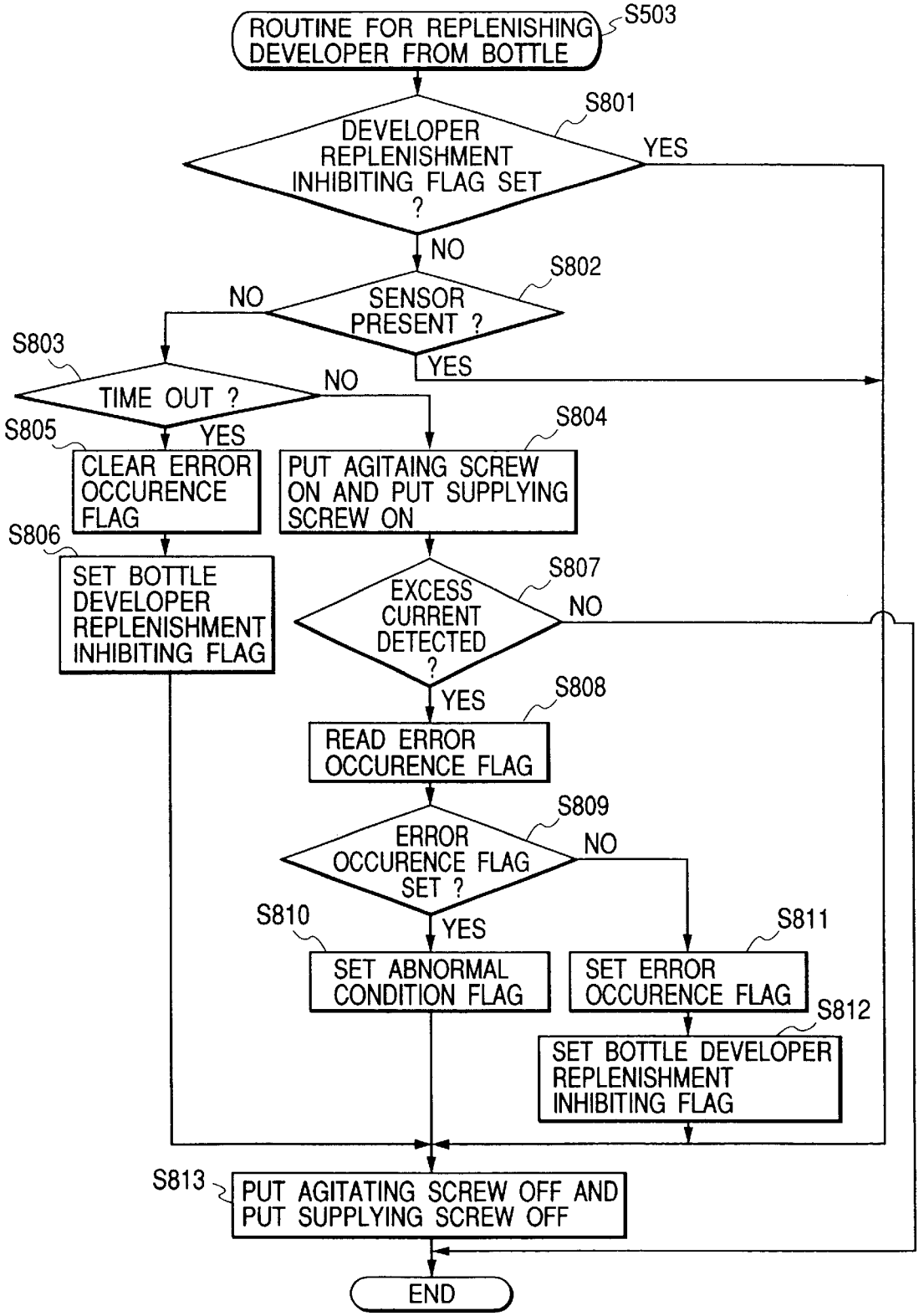
FIG. 8 is a flow chart illustrating the detailed substance of a subroutine for replenishing the developer from a bottle at S503 shown in FIG. 5.

First, at S101, the abnormality detecting flag set at S810 of FIG. 8 is examined, and if it is set, advance is made to S102, where the display of an abnormal condition as shown in FIG. 14 is effected, and the subroutine is ended.

On the other hand, if at S101, the abnormality detecting flag is not set, advance is made to S103, where whether the image formation inhibiting flag is set is examined.

Figure 12:
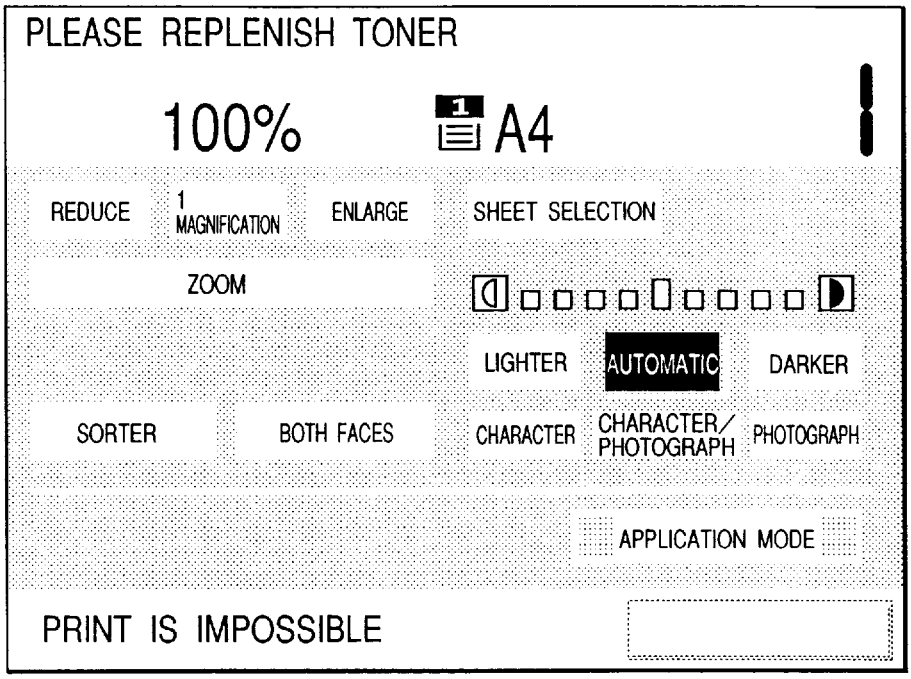
FIG. 12 shows an example of the display by displaying means for displaying an image formation inhibiting condition.

If at S103, the image formation inhibiting flag is set, advance is made to S104, where the display of the image formation inhibiting condition as shown in FIG. 12 is effected, and the subroutine is ended.

On the other hand, if at S103, the image formation inhibiting flag is not set, advance is made to S105.

Figure 16:
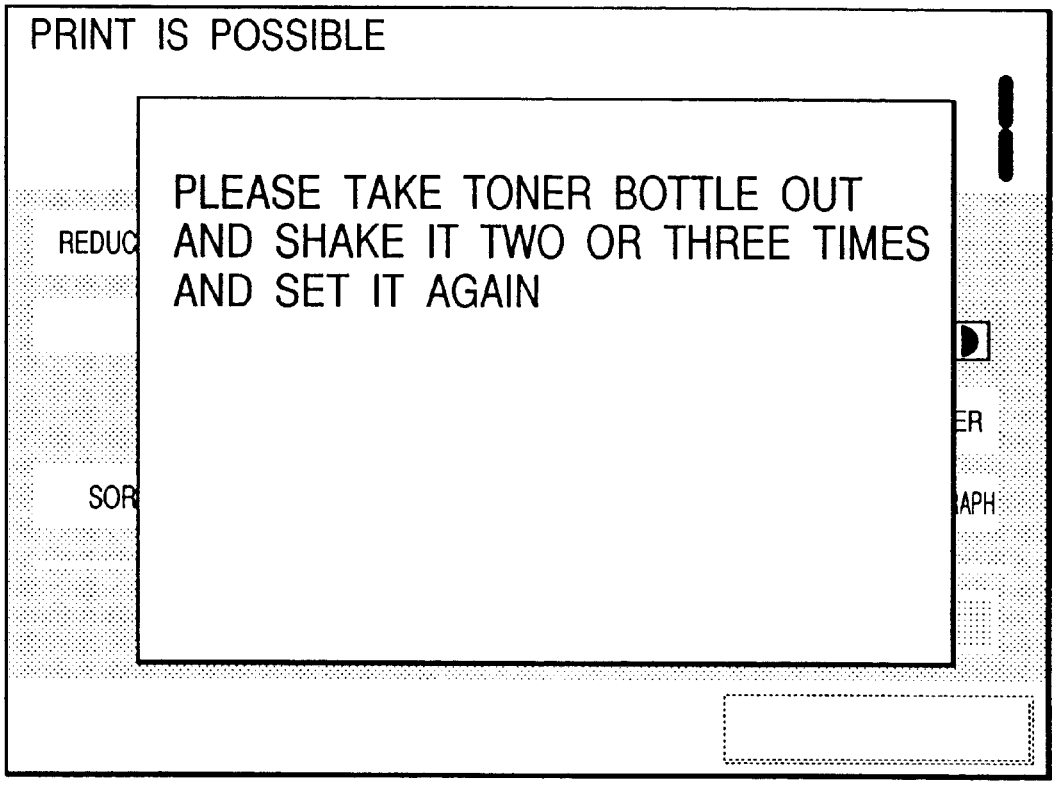
FIG. 16 shows an example of the display by displaying means for displaying the inhibited condition of the replenishment of the developer supply from the bottle.

At S105, whether the bottle developer replenishment inhibiting flag is set is examined, and if it is set, advance is made to S106, where the display of the bottle developer replenishment inhibiting condition as shown in FIG. 15 or FIG. 16 is effected.

Figure 13:
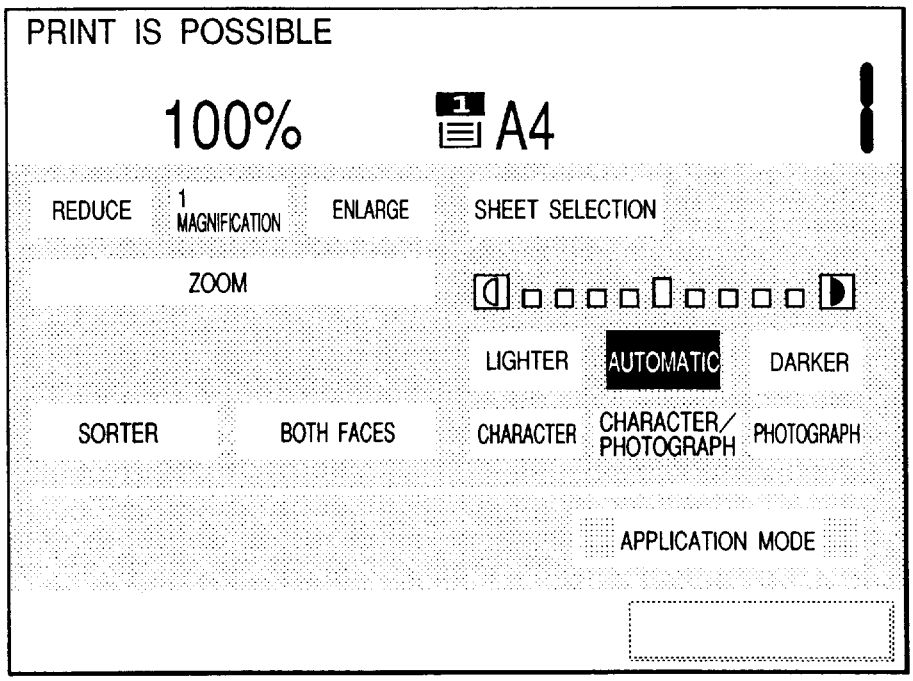
FIG. 13 shows an example of the display by displaying means for displaying a normal condition.

On the other hand, if at S105, the bottle developer replenishment inhibiting flag is not set, advance is made to S107, where the display of a normal condition as shown in FIG. 13 is effected, and the subroutine is ended.

Consequently, according to the present embodiment, there can be provided an image forming apparatus in which when the excess current detecting circuit 30 detects the abnormality of the load of the driving motor 29, in the case of the first abnormality detection after the interchange of the bottle 42 (after the start of the developer supply replenishment by the bottle), it is not regarded as the occurrence of abnormality, but is regarded as an abnormal condition only when abnormality is again detected after the detachment of the bottle 42 has been effected, whereby replenishment can be restored without stopping the operation of the image forming apparatus in the case of abnormal driving caused by the inclination or solidification of the developer in the bottle 42, whereby any reduction in the work efficiency of the user of the image forming apparatus can be prevented.

What is claimed is:

1. A developer replenishing mechanism comprising:

a developer replenishing apparatus for replenishing a developer, said developer replenishing apparatus being provided with a storing container containing the developer therein and capable of discharging the developer therefrom, and detachably attachable to a main body of said developer replenishing apparatus, and a carrying member provided in said storing container for carrying the developer;

a developing apparatus receiving replenishment of the developer from said developer replenishing apparatus;

detecting means for detecting a driving load of a driving portion of said carrying member; and control means for interrupting a discharging operation of said storing container without inhibiting a developing operation of said developing apparatus when it is detected at a first time by said detecting means that said driving load is not less than a predetermined value, wherein said control means interrupts the discharging operation of said storing container, and thereafter resumes the discharging operation of said storing container after said storing container is detached with respect to said main body of said developer replenishing apparatus and is again attached thereto, and thereafter inhibits the developing operation of said developing apparatus and interrupts the discharging operation of said storing container when it is detected at a second time by said detecting means that said driving load is not less than said predetermined value.

2. A developer replenishing mechanism according to claim 1, further comprising developer detecting means for detecting an amount of developer in said developing apparatus.

3. A developer replenishing mechanism according to claim 2, wherein said control means inhibits the developing operation of said developing apparatus when it is detected by said developer detecting means that the value of developer is less than a predetermined amount while the discharging operation of said storing container is interrupted.

4. A developer replenishing mechanism according to claim 1, further comprising developer detecting means for detecting an amount of developer in said developer replenishing apparatus.

5. A developer replenishing mechanism according to claim 1, wherein said developer replenishing apparatus is provided with a carrying device for containing therein developer discharged from said storing container and carrying it to said developing apparatus.

6. A developer replenishing mechanism according to claim 5, further comprising developer detecting means for detecting an amount of developer in said carrying device.

7. A developer replenishing mechanism according to claim 4 or 6, wherein said control means has memory means for storing the result of detection when it is detected by said detecting means that the driving load is not less than the predetermined value, and after the discharging operation of said storing container has been resumed, the result of detection stored in said memory means is erased when it is detected for a predetermined time by said developer detecting means that the value of developer is less than a predetermined value.

8. A developer replenishing mechanism according to claim 1, further comprising displaying means for displaying that said storing container is detached with respect to said main body of said developer replenishing apparatus and is again attached thereto while the discharging operation of said storing container is interrupted.

9. A developer replenishing mechanism according to claim 8, wherein said displaying means displays that said storing container is detached with respect to said main body of said developer replenishing apparatus and said storing container is shaken, and thereafter is attached to said main body.

10. A developer replenishing mechanism according to claim 1, further comprising detecting means for detecting the attached/detached state of said storing container with respect to said main body of said developer replenishing apparatus.

11. An image forming apparatus comprising:

a storing container for containing a developer, said storing container being attachable to and detachable from said image forming apparatus;

a carrying member for carrying the developer in said storing container;

driving means for driving said carrying member;

developer receiving means for receiving the developer discharged from said storing container by said carrying member;

detecting means for detecting information corresponding to a driving load loaded on said driving means;

control means for controlling a carrying motion of said carrying member in accordance with an output of said detecting means; and display means for effecting a display urging to take out said storing container from said image forming apparatus, shake said storing container, and attach said storing container to said image forming apparatus again, when the carrying motion of said carrying member is interrupted by said control means;

wherein said detecting means effects a detecting again after said storing container is attached to said image forming apparatus again.

12. An image forming apparatus according to claim 11, wherein said control means inhibits a carrying motion of said carrying member when the driving load detected again by said detecting means is not less than a predetermined value.

13. An image forming apparatus according to claim 12, wherein an image forming motion is inhibited when the driving load detected again by said detecting means is not less than a predetermined value.

14. An image forming apparatus according to claims 12 or 13, wherein said display means displays that it is abnormal condition.

15. An image forming apparatus according to claim 11, wherein, when the driving load detected again by said detecting means is smaller than a predetermined value, said control means makes the carrying motion of said carrying member an executable condition.

16. An image forming apparatus according to claim 11, wherein the image forming motion is continuable without being interrupted, when the carrying motion of said carrying member is interrupted by said control means.

17. An image forming apparatus according to claim 11, wherein a developer having an amount according to a consumed amount of the developer in said developer receiving means is replenished from said storing container to said developer receiving means.

18. An image forming apparatus according to claim 17, further comprising developer detecting means for detecting information corresponding to an amount of the developer in said developer receiving means, wherein the amount of the developer replenished from said storing container to said developer receiving means is determined on the basis of an output of said developer detecting means.

* * * * *

UNITED STATES PATENT AND TRADEMARK OFFICE

CERTIFICATE OF CORRECTION

PATENT NO. : 6,381,420 B1
DATED : April 30, 2002
INVENTOR(S) : Mitsuhiko Sato et al.

It is certified that error appears in the above-identified patent and that said Letters Patent is hereby corrected as shown below:

Drawing 8,
Figure 8, "OCCURRENCE" (3 occurrences) should read -- OCCURRENCE --.
Figure 8, "AGITAING" should read -- AGITATING --.

Column 4,
Line 17, "detachably attachably" should read -- detachably attachable --.
Line 57, "p is" should read -- P is --.
Lines 57, 63 and 64, "material p" should read -- material P --.

Column 5,
Lines 6 and 7, "materials p" should read -- materials P --.

Signed and Sealed this

Twenty-third Day of July, 2002

*Attest:*

*Attesting Officer*

JAMES E. ROGAN
*Director of the United States Patent and Trademark Office*